US006015189A

United States Patent [19]

Broadhead et al.

[11] Patent Number: 6,015,189

[45] Date of Patent: Jan. 18, 2000

[54] ADJUSTABLE CHAIR

[75] Inventors: Douglas Broadhead, Scarborough; Richard Eakins; Czeslaw Cimachowski, both of Toronto; Brian Bentley, Pickering; Joe Krommenhoek, Toronto; Son Ma, Scarborough; David Harding; Nelson Pang, both of Toronto, all of Canada

[73] Assignee: Genus Medical Inc., Canada

[21] Appl. No.: 08/258,854

[22] Filed: Jun. 13, 1994

Related U.S. Application Data

[63] Continuation-in-part of application No. 07/788,258, Nov. 5, 1991, Pat. No. 5,320,412.

[51] Int. Cl.[7] ..... A47C 1/024

[52] U.S. Cl. ..... 297/353; 297/284.7; 297/358; 297/61

[58] Field of Search ..... 297/61, 284.1, 297/326–328, 353, 284.7

[56] References Cited

U.S. PATENT DOCUMENTS

| | | | |
|---|---|---|---|
| 3,289,222 | 12/1966 | Nielsen | 297/284.7 X |
| 3,871,704 | 3/1975 | Shoemaker et al. | 297/61 |
| 5,150,948 | 9/1992 | Volkle | 297/353 X |
| 5,193,880 | 3/1993 | Keusch et al. | 297/353 |
| 5,346,283 | 9/1994 | Steininger et al. | 297/284.1 X |

FOREIGN PATENT DOCUMENTS

| | | | |
|---|---|---|---|
| 596867 | 4/1960 | Canada | 297/61 |

*Primary Examiner*—Peter R. Brown

*Attorney, Agent, or Firm*—Thomas A. O'Rourke

[57] ABSTRACT

The present assembly relates to a link assembly for a chair. The assembly includes a frame link for connecting to a frame of the chair and a back support link for connecting to a back support of the chair. The frame link and the back support link are pivotably connected in order to facilitate displacement of the back support according to movement of a back frame of the chair. An adjustable pivot point is located on one of the links for selectively adjusting the extent of displacement of the back support relative to the back frame.

16 Claims, 10 Drawing Sheets

ADJUSTABLE CHAIR

This is a continuation-in-part of application Ser. No. 07/788,258 filed Nov. 5, 1991, U.S. Pat. No. 5,320,412.

FIELD OF THE INVENTION

The present invention relates to adjustable chairs.

BACKGROUND OF THE INVENTION

A common type of adjustable chair is the motorized wheel chair, which has helped make the life of a handicapped person more comfortable and more independent. Motorized wheel chairs generally have a seat frame and a back frame, both of which are adjustable relative to a base frame. A back support is usually provided on the back frame to receive the trunk of the user. In some cases, the back support is movable relative to the back frame. The adjustment of these components is made possible by what is referred to in the art as "tilt", "recline" and "zero-shear" mechanisms. Several terms relating to these mechanisms and used commonly amongst those skilled in the art are as follows:

"Tilt" refers to a change in angle of the seat frame relative to the wheel chair frame, while the angle of the back frame relative to the seat frame stays constant.

"Recline" refers to a change in the angle of the back frame relative to the seat frame. In this case, the angle of the back frame relative to the seat frame increases or decreases to the desired back frame position while the seat frame angle relative to the wheel chair frame stays constant.

"Shearing" refers to the shear or tangential forces that occur as a result of the relative displacement between the user's trunk and the back support. This occurs because the center of rotation of the user's trunk (approximately located at the user's hip joint) does not coincide with the axis of rotation of the back frame. Shearing is a problem because it can cause decubitus ulcers (pressure sores) on the user's body and because it creates problems in maintaining the correct position of the postural supports (e.g. chest pads, headrests) and control devices (e.g. chin control systems) relative to the user.

"Zero-Shear" is an industry used term that refers to a reclining back system that uses a mechanism which significantly reduces (but not necessarily completely eliminates) the effects of shear. Because the back support moves with the user, postural support and control devices are often attached to the back support to maintain correct positioning of these devices relative to the user.

Typically, zero-shear systems utilize a sliding back support that is either attached to the back frame with glide blocks or rollers. Sliding back supports are usually actuated with mechanical linkages, cam or cable systems and travel at a fixed speed relative to the rotation of the back frame. The conventional devices have been found to be unsatisfactory, since they fail to take into account the specific needs of each user, which tend to change from one user to another.

Conventional motorized wheel chairs have also been outfitted with "anti-tipping" wheels emerging from the chair to support the chair from overturning. However, there are some instances where conventional "anti-tipping" wheels fail to prevent overturning because they fail to take into account that the center of gravity of the user may shift as the chair is adjusted.

It is therefore an object of the present invention to obviate or mitigate the above-mentioned disadvantages.

SUMMARY OF THE INVENTION

In one aspect the invention provides a link assembly for use in adjustably displacing a back support assembly for use in a chair having a back frame that reclines relative to a seat frame, said chair including a back support that is mounted to said back frame for linear displacement relative thereto, said assembly comprising:

a frame link apparatus having a first member and a second member, each said member being adapted to be connected at a pivot point to the seat frame;

a back support link apparatus that is adapted to be connected at a pivot point to the displaceable back support;

said first member and second member connecting at pivot points to said back support link apparatus to facilitate linear displacement of said back support to radial movement of said back frame relative to said seat frame; and adjustment means located on at least one of said link apparati for selectively adjusting the distance from one of said pivot points interconnecting said link apparati to one of said pivot points for said seat frame and said back support, said adjustment means facilitating adjustment of the extent of linear displacement of said back support relative to said movement of said back frame.

In another aspect the invention provides a chair comprising a base frame;

a seat frame connected to the base frame;

a back frame pivotally connected to the seat frame;

a displacable back support carried by said back frame;

means disposed between said back frame and said seat frame for moving said back frame relative to said seat frame;

a link assembly connected to said back support and to said seat frame for displacing said back support relative to said back frame according to movement of said back frame relative to said seat frame;

said link assembly including a frame link apparatus having a first member and a second member, each said member being adapted to be connected at a pivot point to the seat frame, and a back support link apparatus that is adapted to be connected at a pivot point to the displaceable back support;

said first member and said second member connecting at pivot points to said back support link apparatus to facilitate linear displacement of said back support according to radial movement of said back frame relative to said seat frame; and adjustment means located on said link assembly for selectively adjusting the distance from one of said pivot points interconnecting said link apparati to one of said pivot points for said seat frame and said back support, said adjustment means facilitating adjustment of the extent of linear displacement of said back support relative to said movement of said back frame.

BRIEF DESCRIPTION OF THE DRAWING FIGURES

Several embodiments are illustrated by way of example only in the appended drawings, in which.

Figure 1:
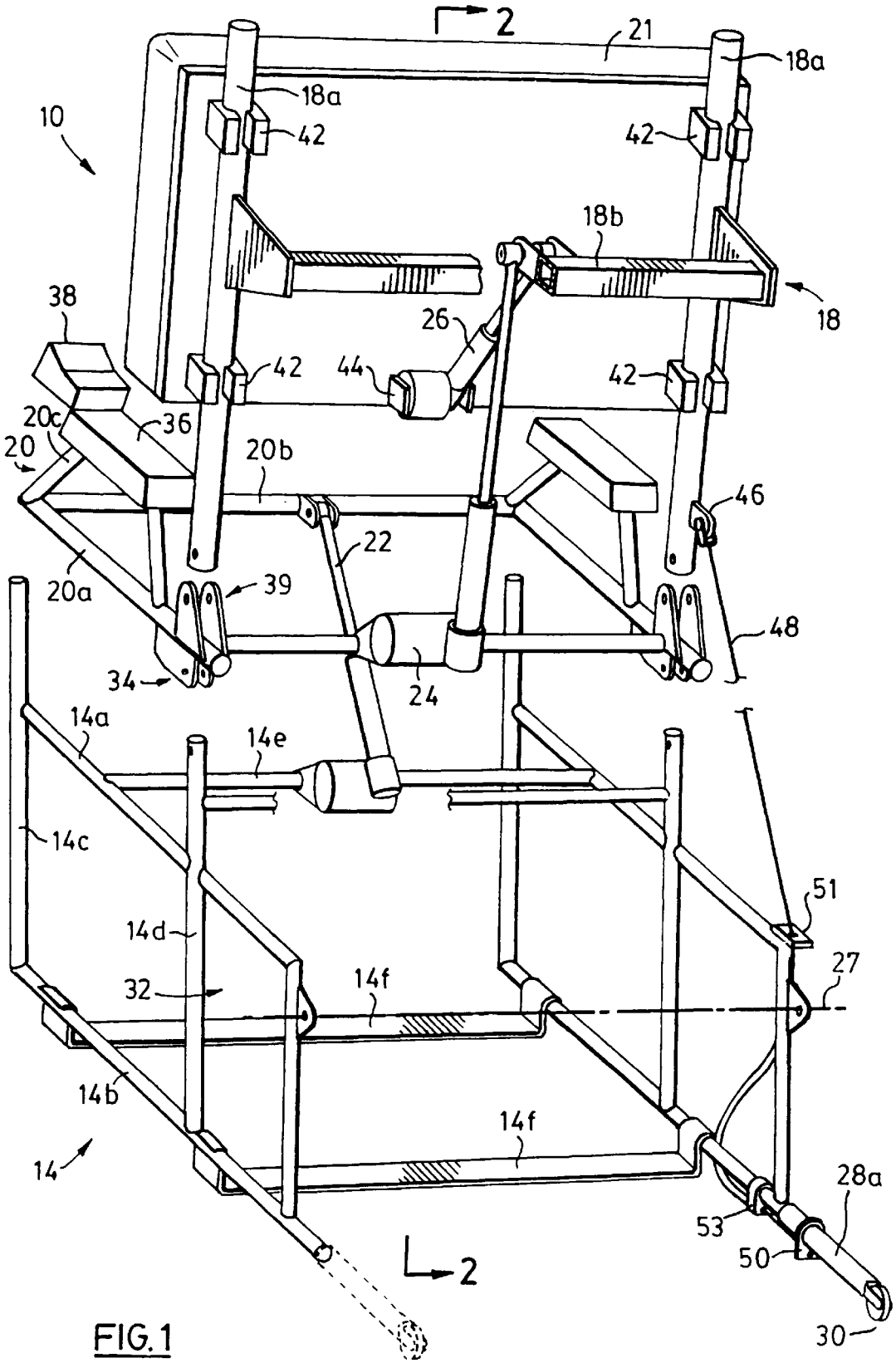
FIG. 1 is an exploded perspective view of a frame for motorized wheel chair according to one embodiment of the present invention.
Figure 2:
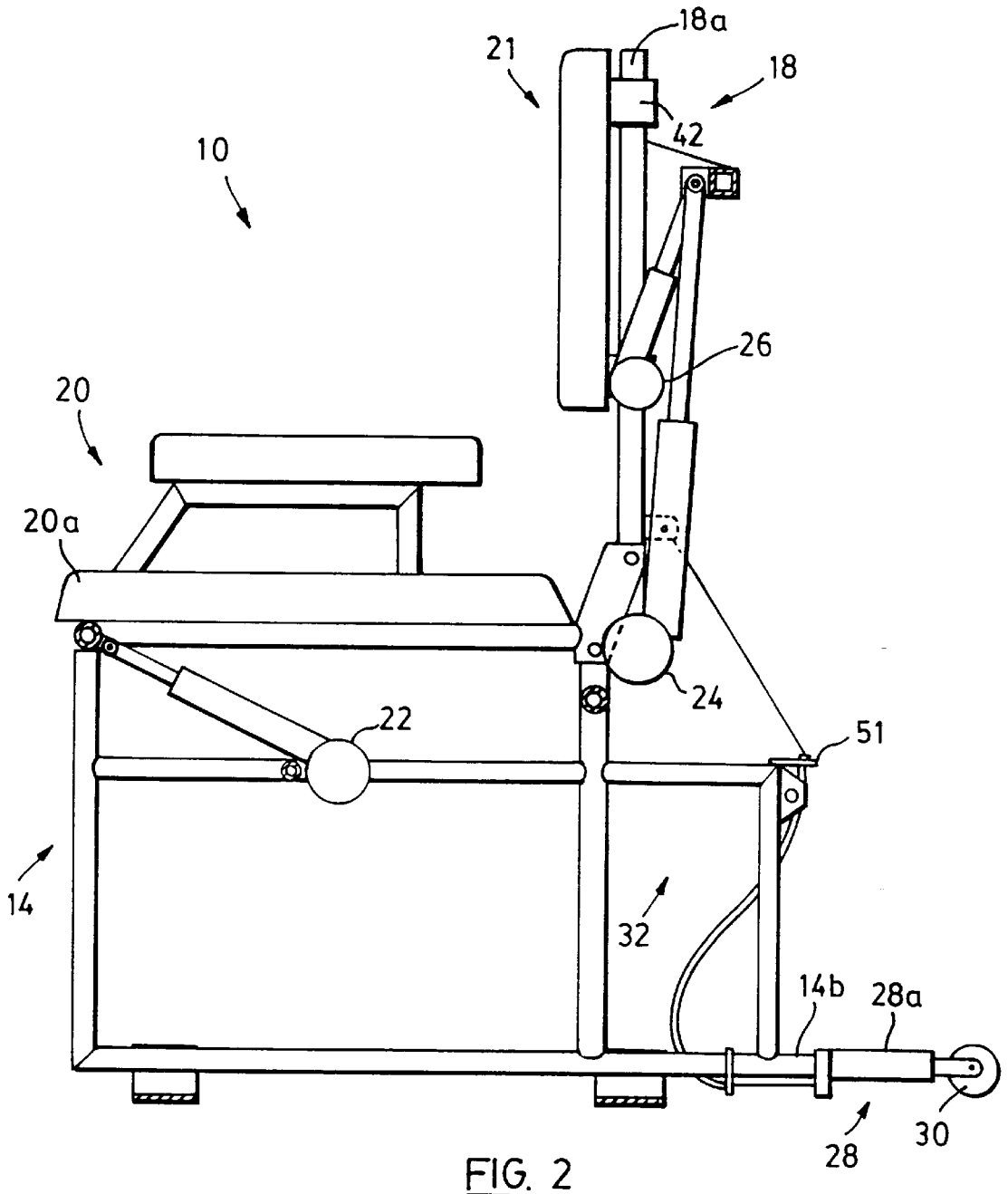
FIG. 2 is a sectional view taken on line 2—2 of FIG. 1.
Figure 5:
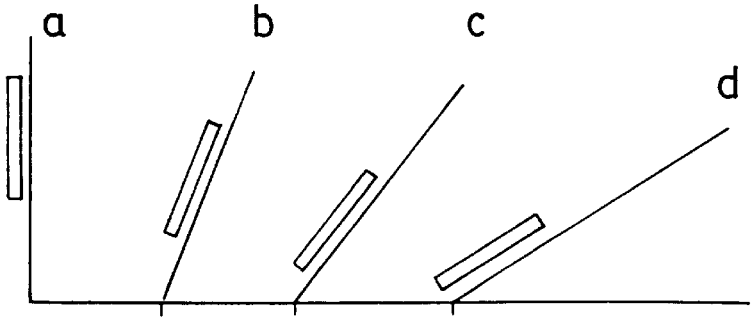
Figure 6:
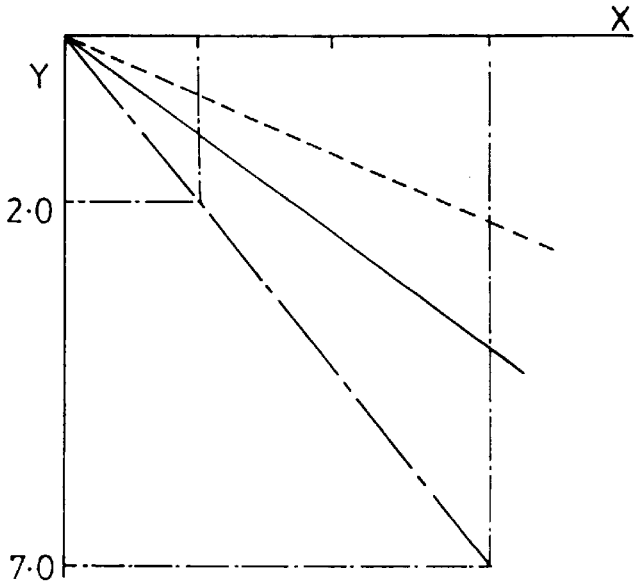

FIGS. 5*a* to *d* are schematic views of another portion of the wheel chair illustrated in FIG. 1;

FIG. 6 is a graph corresponding to FIGS. 5*a* to *d;*

Figure 8:
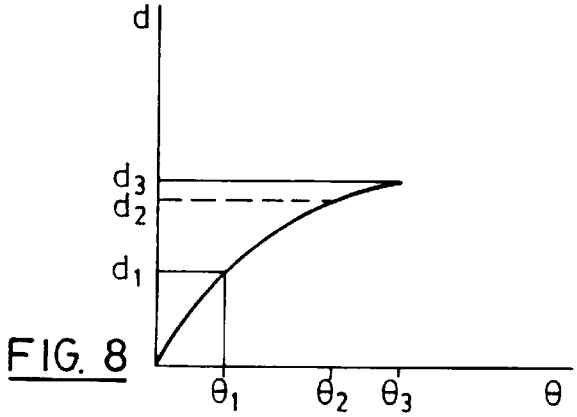
Figure 7A:
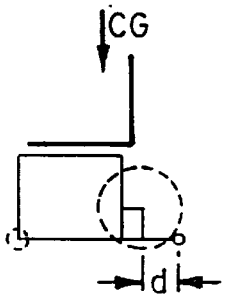
Figure 7B:
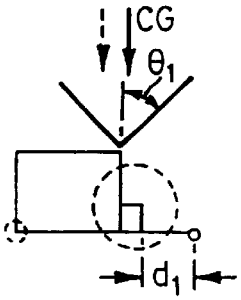
Figure 7C:
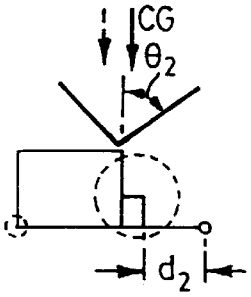
Figure 7D:
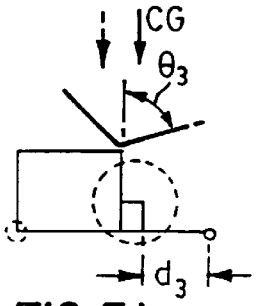

FIGS. 7*a* to *d* are schematic side views of the wheel chair illustrated in FIG. 1;

FIG. 8 is a graph corresponding to FIGS. 7*a* to *d;*

Figure 10:
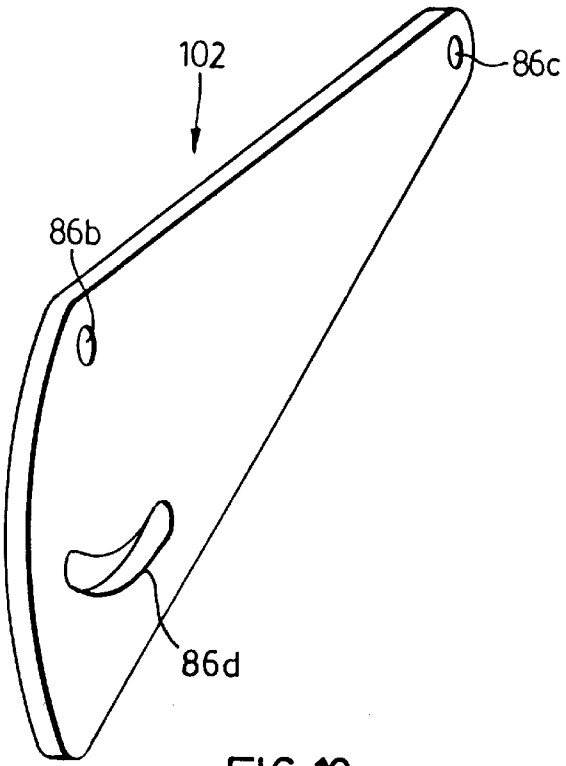
Figure 9:
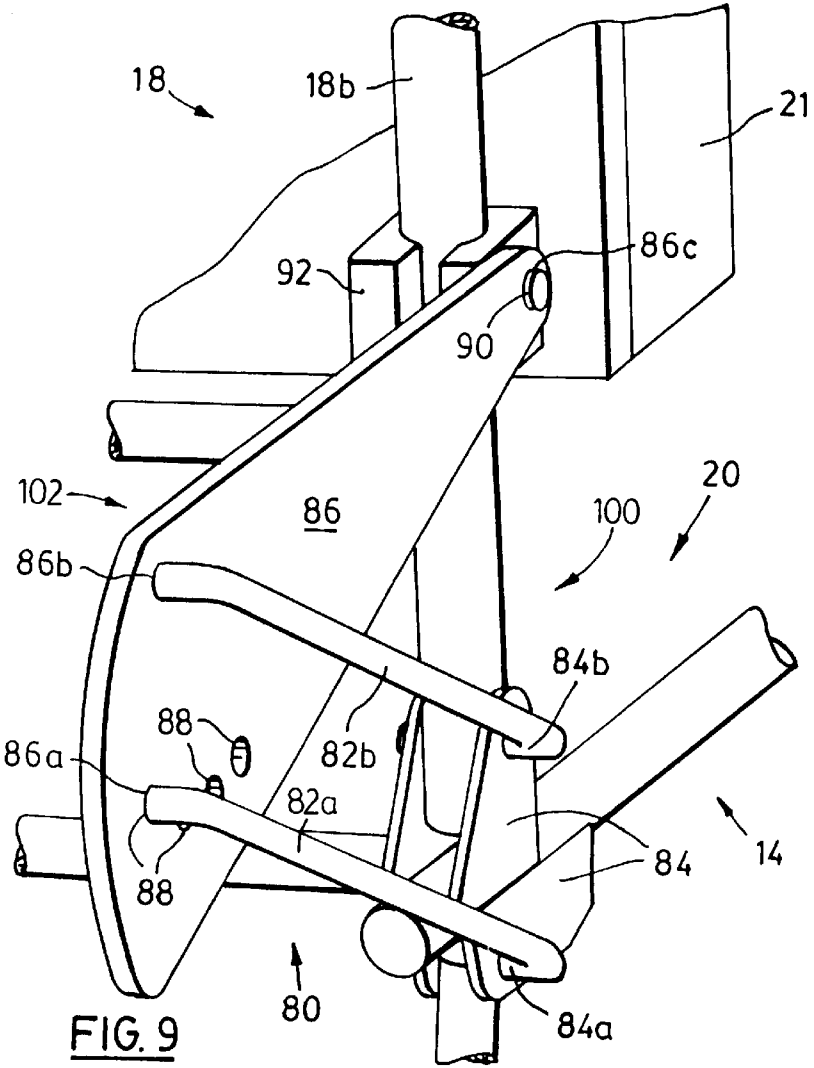
Figure 11A:
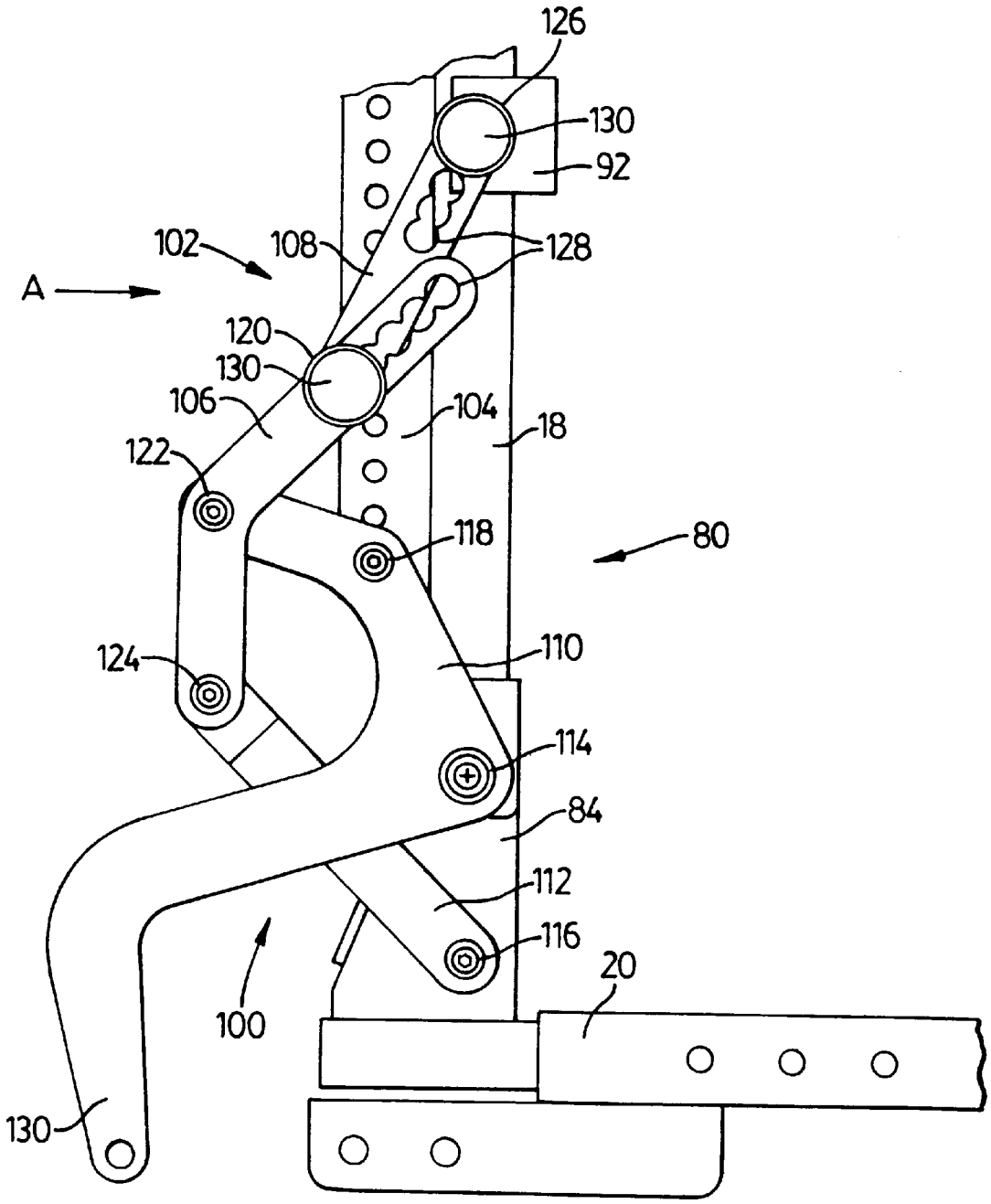
Figure 11B:
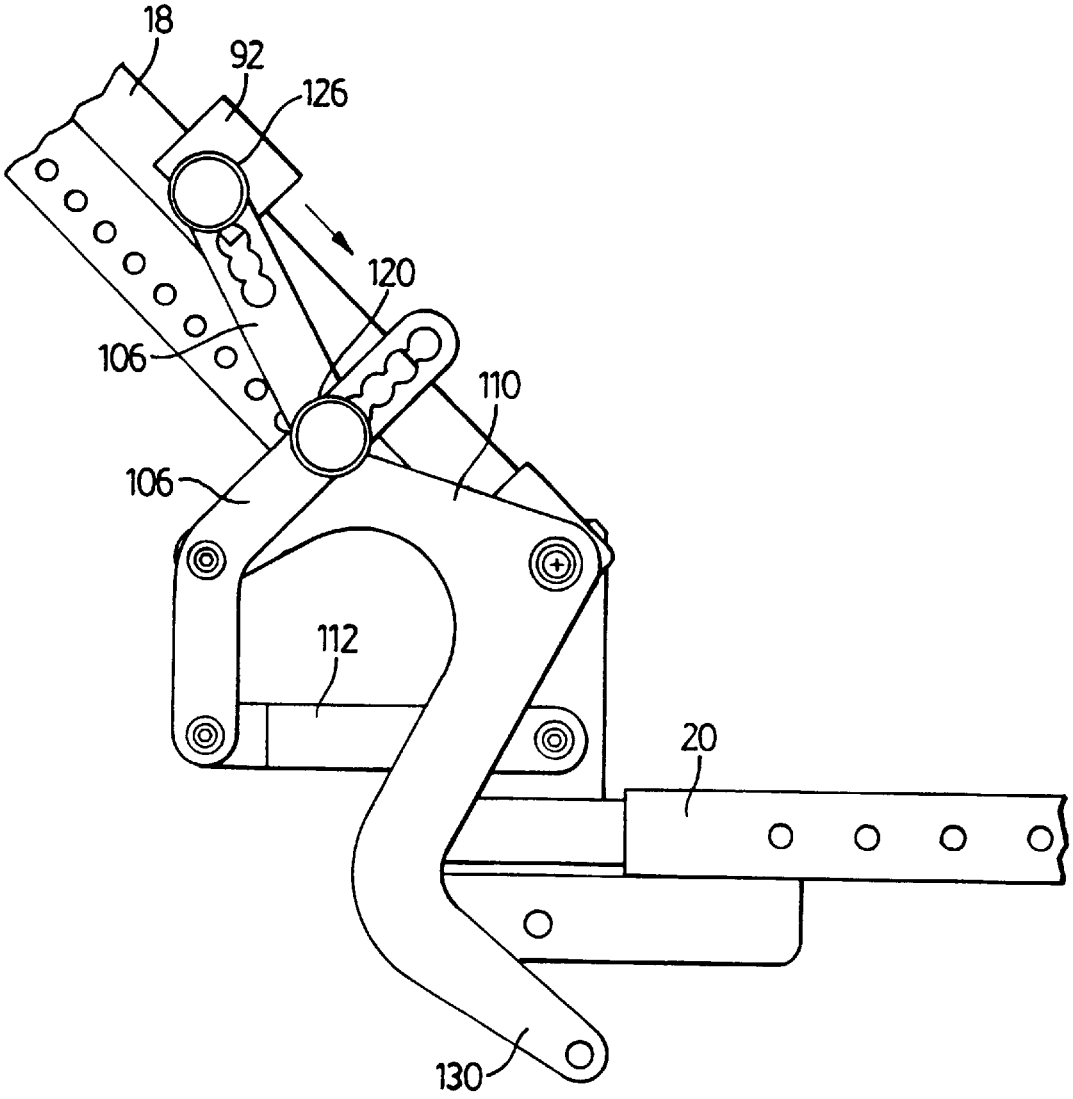
Figure 11C:
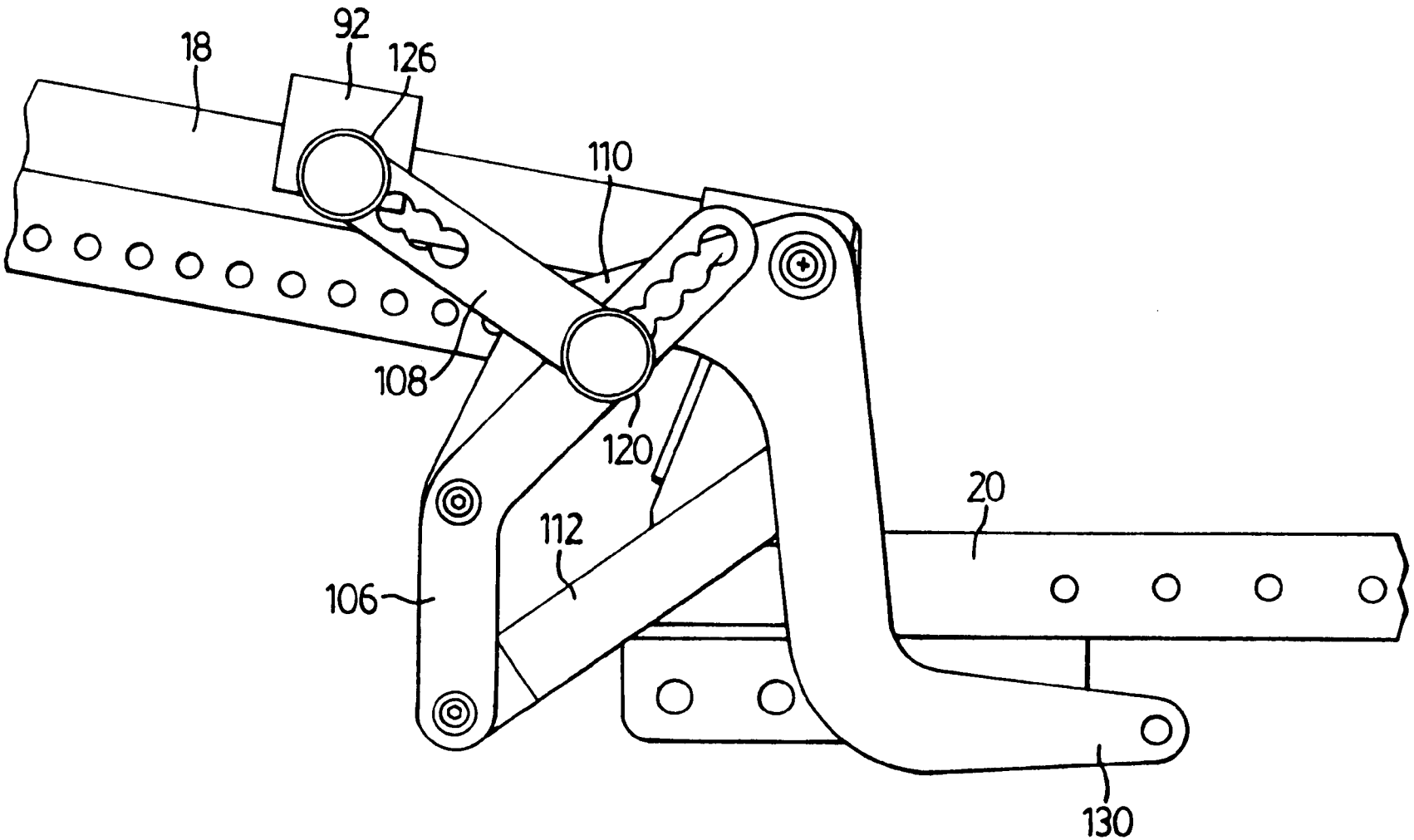
Figure 12:
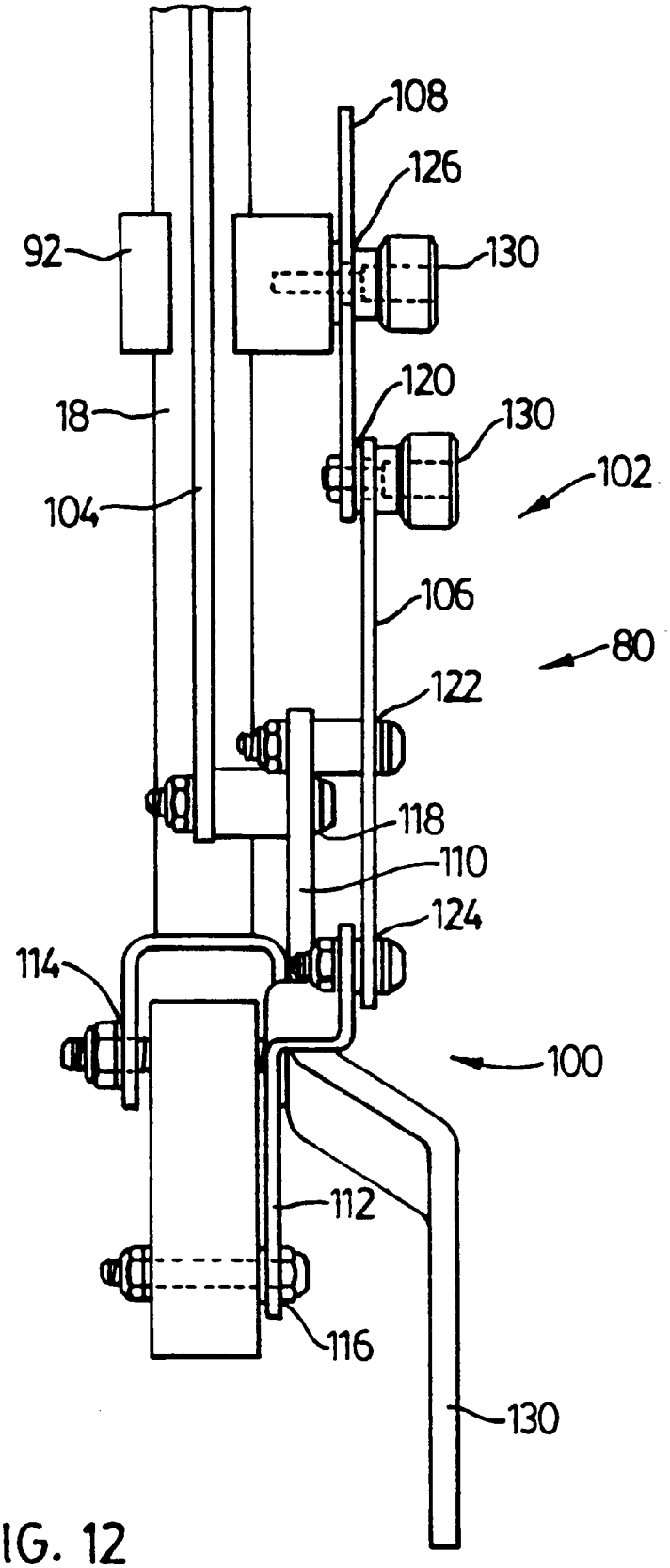

FIG. 9 is a fragmentary perspective view of a portion of a wheel chair incorporating a link assembly according to the present invention;

FIG. 10 is a perspective view of an alternative embodiment of a back support link apparatus from the link assembly illustrated in FIG. 9;

FIGS. 11*a* to *c* are fragmentary side views of a second embodiment of link assembly according to the present invention, the Figures showing the back frame in succeeding stages of recline; and FIG. 12 is an end view of the link assembly shown in FIG. 11*a* as viewed in the direction of arrow A.

DESCRIPTION OF PREFERRED EMBODIMENTS

Referring to the figures, there is provided a motorized wheel chair 10, having a base frame 14. A back frame 18 and a seat frame 20 are pivotally coupled to the base frame 14. The seat frame carries seat support 20*a*. A back support 21 is mounted on the back frame 18 for displacement relative thereto and is arranged to receive the trunk portion of a user (not shown). There is provided a means of rotating the seat frame 20 relative to the base frame 14 in the form of a tilt actuator 22, a means of rotating the back frame 18 relative to the seat frame 20 in the form of a recline actuator 24 and a means of displacing the back support 21 relative to the back frame 18, in the form of a zero-shear actuator 26. The linear actuator is known and thus will not be discussed further. The base frame 14 supports a drive train driving a wheel assembly, the rear wheels of the wheel assembly being shown schematically in FIGS. 3 and 7*a* to *d*. The rear wheels have an axis of rotation identified by line 27.

Figure 3:
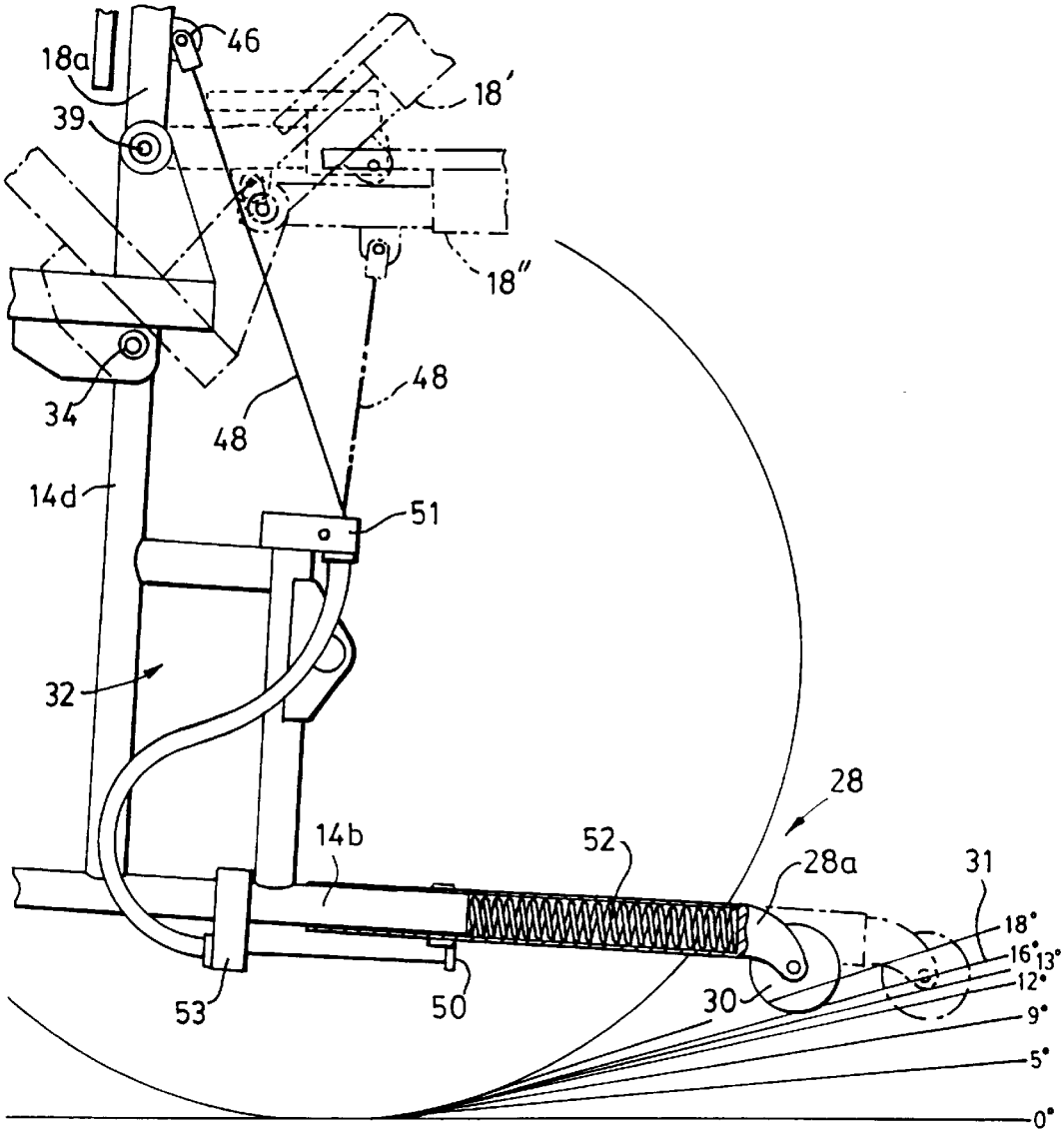
FIG. 3 is a fragmentary side view of one portion of the wheel chair illustrated in FIG. 1.

An anti-tipping mechanism 28 is also provided on a lower portion of the base frame 14 and includes a pair of support elements in the form of wheels 30. The wheels are arranged to contact the floor surface upon tipping of the chair. Line 31 in FIG. 3 illustrates the floor surface contacting the wheel 30 when the chair is tipped rearwardly. As will be described, the wheels 30 are movable between a position near said wheel assembly and a position relatively remote therefrom and are responsive to changes in orientation of said back frame 18 relative to the base frame 14. In this manner, the anti-tipping mechanism 28 is responsive to changes in position of a centre of gravity of the user so as to place the wheels 30 at the remote position when the centre of gravity is shifted rearwardly and to place the wheels at the near position when the centre of gravity is shifted forwardly.

The base frame 14 has upper and lower longitudinal members 14*a* and 14*b* on both the left and right hand sides as viewed by the user. Front and rear uprights 14*c*, 14*d* on both sides are joined to the longitudinal members as are upper and lower transverse members, 14*e* and 14*f*, the transverse members 14*f* arranged to carry a battery pack (not shown).

A base frame extension 32 is provided on each side of the chair 10 immediately aft of the corresponding rear upright 14*d* and carries the anti-tipping mechanism 28 as will be discussed.

The seat frame 20 includes a pair of longitudinal members 20*a* and a pair of transverse members 20*b*. A pair of pivot couplings 34 are provided at each of the rear corners of the seat frame 20 to pivot the seat frame 20 relative to the base frame 14. A pair of arm supports 20*c* extend upwardly from both longitudinal members 20*a* and each carry an arm pad 36. The left hand arm support 20*c* also carries a control unit 38. The front transverse member 20*b* has a mounting flange which carries one end of the tilt actuator 22.

The back frame 18 includes a pair of uprights 18*a* joined to an upper transverse member 18*b*. A pivot coupling 39 is provided between the lower end of each upright 18*a* and the rear end of each longitudinal member 20*a* of the seat frame 20 to permit the back frame 18 to pivot relative to the seat frame 20. Four sliding blocks 42 are slidably mounted on the upright 18*a* and in turn are fixed to a respective corner of the back support 21.

The upper transverse member 18*b* serves as an anchor for one end of both the recline and zero-shear actuators 24 and 26. The other end of the zero-shear actuator is pivotally coupled to a flange 44 emerging from the lower portion of the back support 21, while the opposite end of the recline actuator 24 is mounted on the rear transverse member 20*b* of the seat frame 20.

Each upright 18*a* of the back frame 18 is also provided with an anchor flange 46 to receive one end of a cable 48, the opposite end of which is secured to another anchor flange 50 on the anti-tipping mechanism 28. The cable 48 is further supported by a mount 51 on the corner of the base frame extension 32 and a mount 53 on the lower longitudinal member 14*b*. For the sake of simplicity, only one anti-tipping mechanism 28 is illustrated in detail in the figures.

Figure 4:
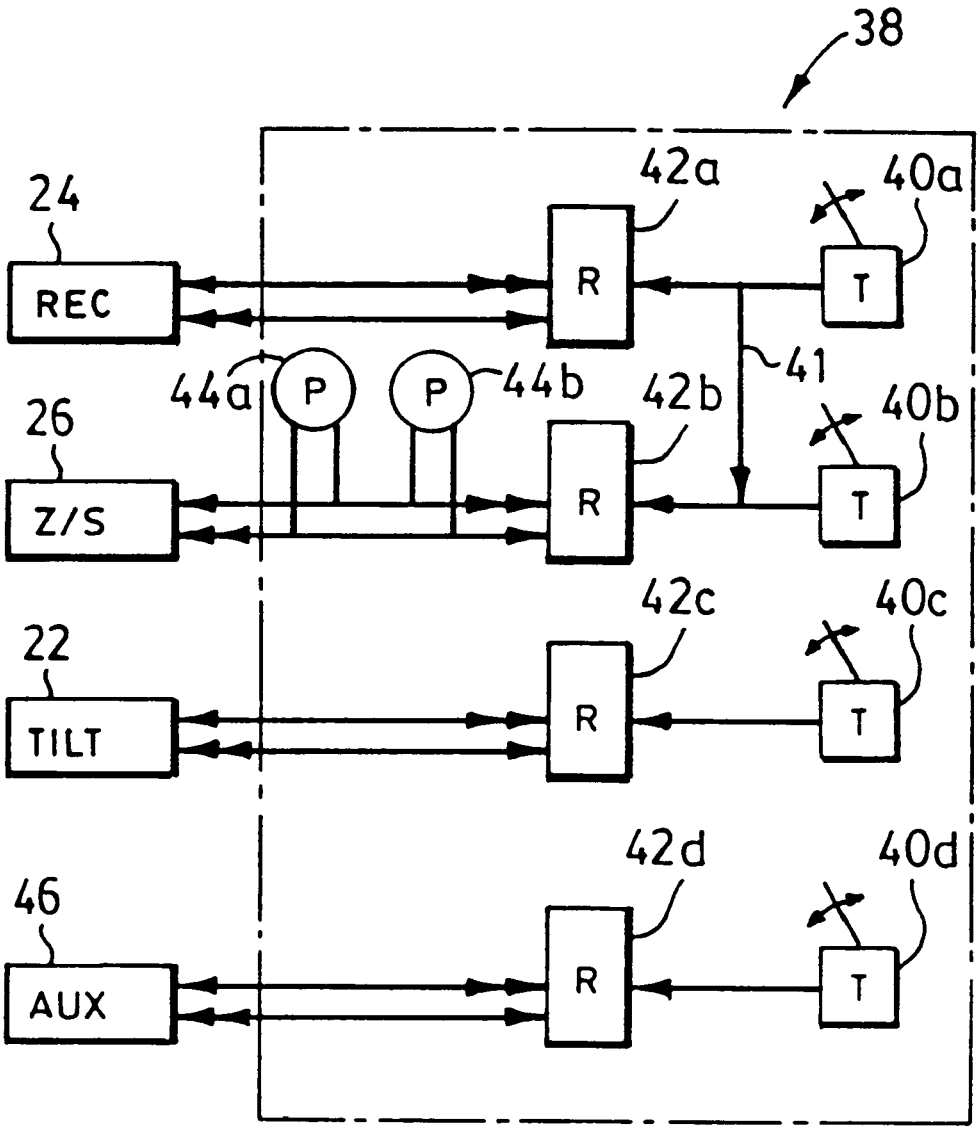
FIG. 4 is a schematic view of another portion of the wheel chair illustrated in FIG. 1.

As will be described, the control unit 38 functions to vary the displacement of the back support 21 according to the rotation of the back frame 18 relative to the seat frame 20 in order to minimize shear forces appearing between the user's trunk and the back support 21. The control unit 38 is schematically illustrated in FIG. 4 and enables the user to adjust the tilt, recline and zero-shear actuators 22, 24 and 26 respectively. The control unit 38 has a number of toggle switches 40*a* to 40*d* which convey a signal to relays 42*a* to 42*d* respectively. Toggle 40*a* is also coupled to relay 42*b* by way of conductor 41 to permit toggle 40*a* to activate relays 42*a* and 42*b* at the same time. Each of the relays 42*a* to 42*d* has an output coupled to an exterior device, such as recline, zero-shear and tilt actuators 22, 24, 26 or to an auxiliary device as is shown at 46, for example a power leg lift actuator.

Located on the output of relay 42*b* are a pair of potentiometers 44*a*, 44*b* which are used to vary the power delivered to the zero-shear actuator 26 as will be described.

The toggles and relays are arranged in such a way that the actuators may be powered in two different directions, that is in an upward and downward direction by using the same toggle activated in the same direction. Of course, other switching arrangements may be used to activate the relays, including an interface with a directional controller found on some motorized wheel chairs.

A particular feature of the control unit 38 is the ability to calibrate the chair so that the displacement of the zero-shear actuator may be optimized for the particular needs of each user in a simple and economic manner. This is done by controlling the relative displacement of the zero-shear actuators 26 relative to the recline actuator 24 through adjusting the potentiometers 44*a*, 44*b*, which in turn varies the amount of power being delivered to the zero-shear actuator in the inward direction (that is toward the pivot coupling 39) and outward direction. The two potentiometers are of the type having a diode configuration as is known in the art and allow the speed of the zero-shear actuator in the inward direction to be adjusted independently of the speed in the outward direction. This enables the user to compensate for the effects of gravity by providing an increased amount of power to the zero-shear actuator in the outward direction. Without this compensation, the zero-shear actuator would tend to travel faster in the inward direction.

Thus, as the back frame 18 reclines, the back support 21 slides inwardly toward the pivot couplings 39. Shearing is significantly reduced because the back support 21, in effect, stays in contact with the user's trunk with little or no relative movement. With the toggle 40*b*, the user may adjust the zero-shear actuator independently of the recline actuator.

For example, one user may need to have the back support 21 move only two inches during the full downward rotation of the back frame 18. In this case, the potentiometer is adjusted so that only that amount of power is delivered to the zero-shear actuator to cause it to displace the back support 21 at a speed resulting in two inches of travel in the time it takes to rotate the back between the fully upright position (as shown for example FIG. 5*a*) and fully reclined position (as shown in FIG. 5*d*). This situation is illustrated in FIG. 6 wherein the dashed line represents two inches in a fully reclined position.

Similarly, another user may need to have the back support 21 travel seven inches between the fully upright and fully reclined positions of the back frame 18. Accordingly, the potentiometer is to be set to deliver a correspondingly higher amount of power to the zero-shear actuator. This example is illustrated by the chain-dot line in FIG. 6.

Once the desirable potentiometer adjustments have been made, the user merely has to operate toggle 40*a*, causing the zero-shear actuator to displace the back support 21 while the back frame 18 is being reclined. Another toggle or hit of the toggle switch 40*a* in the same direction causes the polarity of the power delivered to the recline and zero-shear relays to be reversed causing the back frame 18 to be returned to its fully upright position.

While the back frame 18 is reclining relative to the seat frame 20, the cable 48 is displaced causing the anti-tipping mechanism 28 to extend the wheel 30 outward. In this economical manner, the anti-tipping mechanism 28 need not be separately controlled by the control unit 38.

The anti-tipping mechanism 28 includes an outer tube member 28*a* telescopingly engaged with the rear section of a corresponding lower longitudinal member 14*b* and is outwardly spring biased by a compression spring shown at 52. Mounted on the remote end of each outer tube member 28 is one of the wheels 30. As can be seen by FIG. 3, the wheels 30 are spaced from the floor surface a sufficient distance to avoid obstacles while being close enough to the floor surface to provide support should the wheel chair tip rearwardly.

A particular feature of the anti-tipping mechanism 28 is that the wheel 30 is in an operative position through its full displacement. In addition, the anti-tipping device is arranged so that the location of the wheel 30 changes with changes in the position of the back frame 18 (as illustrated, for example, at 18, 18' and 18") relative to the base frame 14 of the chair. This ensures that the location of the wheel 30 varies with any shift of the user's centre of gravity. This relationship is illustrated in FIGS. 7*a* to *d*. As the back frame 18 rotates downwardly, the centre of gravity, as represented by the vector 'CG' shifts rearwardly, that is, to the right as viewed in the FIGS. 7*a* to *d*. In turn, the wheel 30 is displaced rearwardly.

It will be seen that the displacement and location of the wheel 30 is a function of the following variables:

i) the length of the cable 48;

ii) the locations of the flanges 46, 50 and mounts 51, 53; and iii) the locations of the pivot couplings 34 and 39.

Accordingly, the displacement and location of the wheel relative to the back frame may be adjusted if desired by altering these variables.

When the back frame 18 is returned to its full upright position, the wheel 30 is retracted. Thus, the anti-tipping mechanism 28 maintains the user's support through all back frame 18 inclinations, while improving manoeuvrability by keeping the wheels 30 out of the way when the user's centre of gravity is not in a position requiring the wheels to be remotely located.

Another advantage of the spring biased anti-tipping mechanism 28 is that, in most situations, the outer tube member 28*a* is only partially telescoped with the rear section of the lower longitudinal member 14*b*, which means that the wheels 30 will spring inwardly should they make contact with walls, doors and the like, thereby reducing damage. As soon as the wheel 30 moves away from the obstacle, it returns to its appropriate position, which would be sufficient to prevent the chair from tipping over in normal situations.

Should the cable 48 break, the outward spring biased wheel 30 immediately springs to the fully extended position, thereby ensuring that the user's safety is maintained. Of course, the outwardly biasing spring could be replaced by some other biasing member or could perhaps be integrated into the control unit 38 by making use of a linear actuator to displace the wheel.

In FIGS. 9–12, the zero-shear linear actuator 26 is replaced by a mechanical link assembly 80 for displacing the back support 21 relative to the back frame 18. The assembly 80 includes a frame link apparatus 100 and a back support link apparatus 102.

The frame link apparatus 100 includes a pair of parallel first and second link members 82*a* and 82*b*. The link members 82*a*, 82*b* are pivotally connected to a coupling flange 84 joining the seat frame 20 to the back frame 18 at first and second pivot points 84*a*, 84*b*. The opposite ends of the first and second link members 82*a* and 82*b* are pivotally connected to spaced locations on the back support link apparatus 102 at fourth and fifth pivot points 86*a*, 86*b*. Pivot point 86*a* is adjustable, and is characterized by several pivot holes 88, each of which is arranged to receive the first member 82*a*. The back support link apparatus 102 has a third pivot point 86*c* where it is pivotally connected to the lower block 92 of the back support 21.

The selection of one of the three, or more if desired, adjustable pivot points 88 on the back support link apparatus 102 allows the orientation of the back support link apparatus 102 to be changed relative to the frame link apparatus 100. Any change in the orientation of the back support link apparatus 102 will cause a corresponding change to the travel of the pivot point 86*a* and thus to the back support 21 as the back frame 18 is rotated between a fully upright position and a fully reclined position.

In use, the back frame 18 is reclined either manually or by the reclining linear actuator 24, which causes the parallel link members 82*a* and 82*b* to rotate downwardly. As this occurs, the back support link apparatus 102 rotates causing the adjustable pivot point 86*a* to follow both a downward and outward path. It is this path that can be adjusted by the selection of one of the alternative locations 88, since each location will define a different path to be taken by the back support link apparatus 102 and thus the back support 21.

Alternatively, the adjustable pivot holes 88 may be replaced by a slot 86*d*, as illustrated in FIG. 10 wherein the first member 82*a* is pivoted to a given location along the slot. The advantage with this arrangement is that the location of the pivot point 86*a* is more precisely adjustable along the length of the slot.

A second embodiment of the mechanical link assembly 80 is shown in FIGS. 11*a–c* and FIG. 12.

The second embodiment includes the frame link apparatus 100 and the back support link apparatus 102. The frame link apparatus 100 includes first and second members 110 and 112 that are pivotably connected at one portion to the seat frame 20. As shown, the first and second members 110, 112 are connected at first and second pivot points 114, 116 to the coupling flange 84 that joins the seat frame 20 to the back frame 18. The first member 110 is also pivotably connected at pivot point 118 to an apertured flange 104 on the back frame 18. This serves to directly translate reclining movement of the back frame 18 into rotational movement of the first member 110.

The back support link apparatus 102 includes a third member 106 and a fourth member 108 that are pivotably connected to each other at sixth adjustable pivot point 120. The third member is pivotably connected to both the first and second members 110 and 112 at fourth and fifth pivot points 122 and 124, and the fourth member 108 is pivotably connected to the lower block 92 of the back support 21 at adjustable third pivot point 126. The adjustable pivot points 120 and 126 each comprise a slot 128 defined in the corresponding third and fourth members 106, 108 and a tensioned fastener 130 that allows the pivot point 120, 126 to be adjusted along the slot 128. As shown, the slot 128 includes a series of indentations for defining distinct openings for receiving the fastener 130.

Two means for adjusting the extent of displacement of the back support 21 are provided on the third and fourth members 106, 108. For instance, the amount of displacement of the back support 21 can be reduced by changing the connection point of the fourth member 108 relative to the third member 106 by repositioning the first adjustable pivot point 120 closer to the pivotal connection of third member 106 and the first member 110.

Similarly, the position of the back support 21 can be maintained or changed as the displacement of said back support 21 is adjusted, by repositioning the location of the second adjustable pivot point 126.

In use, the back frame 18*b* is reclined manually or by the recline linear actuator 24, which causes the first and second members 110, 112 to rotate downwardly. As this occurs, the third member 106 rotates causing the first adjustable pivot point 120 to follow a downward rotational path. This is shown in sequence in FIGS. 11*a–c*. It is this path which can be adjusted by adjusting the first or second adjustable pivot points 120, 126.

The first member 110 has an arm 130 that extends below its attachment to the coupling flange 84 in order to receive a pushrod (not shown) which will be connected to a leg rest (not shown) at the other end of the wheel chair. As the back frame 18 is reclined in a downward direction, the arm 130 acts to displace the pushrod in a forward direction, parallel to the seat frame 20, which simultaneously causes the leg rest to elevate.

While the above discussion has been restricted to wheel chairs, it will of course be recognized that some of the features disclosed may be applicable to other support devices, such as dentist chairs.

It should also be recognized that minor variations to the embodiments disclosed therein will not depart from the spirit of the invention. For example, several alternative arrangements exist for the anti-tipping mechanism shown. The tubes need not telescope relative to one another, provided sufficient support is provided for the wheel to be in an operative position in all positions of the back support 21. The back support 21 may of course be mounted on the uprights in a number of different arrangements, including the use of tracks and the like. While the discussion above has been restricted to the use of wheels 30 in the anti-tipping mechanism, it will of course be understood that other forms of support elements may be used such as downwardly projecting support pegs. In addition, the anti-tipping mechanism may be used to support the chair in other locations, for example, the front or the sides thereof. Other means may be employed to displace the support element relative to a given shift of the centre of gravity, including the use of electronic sensors coupled to anti-tipping mechanism in the form of a linear actuator driven support element or the like.

We claim:

1. A link assembly for use in a chair having a back frame that reclines relative to a seat frame, said chair including a back support that is mounted to said back frame for linear displacement relative thereto, said assembly comprising;

a frame link apparatus having a first member and a second member, said members being adapted to be connected at first and second pivot points respectively to the seat frame;

a back support link apparatus that is adapted to be connected at a third pivot point to the displaceable back support;

said first member and said second member connecting at fourth and fifth pivot points respectively to said back support link apparatus to facilitate linear displacement of said back support according to radial movement of said back frame relative to said seat frame; and adjustment means located on at least one of said link apparati for selectively adjusting the distance from one of said fourth or fifth pivot points to one of said first, second or third pivot points, said adjustment means facilitating adjustment of the extent of linear displacement of said back support relative to said movement of said back frame.

2. A link assembly as claimed in claim 1, wherein said first and second members are positioned generally parallel to one another.

3. A link assembly as claimed in claim 1, wherein said adjustment means comprises a plurality of spaced holes defined in said back support link apparatus for selectively adjusting the pivotal connection point of one of said first and second members.

4. A link assembly as claimed in claim 1, wherein said adjustment means comprises a slot defined in said back support link apparatus for selectively adjusting the pivotal connection point of one of said first and second members.

5. A link assembly as claimed in claim 1, wherein said back support link apparatus comprises a third member and a fourth member, said third and fourth members being connected to one another at a sixth pivot point, said third member also being connected at said fourth and fifth pivot points to said frame link apparatus, and said fourth member also being adapted to be connected at said third pivot point to said displaceable back support.

6. A link assembly as claimed in claim 5, wherein said adjustment means comprises a plurality of spaced holes defined in said back support link apparatus for selectively adjusting the pivotal connection point of one of said first and second members.

7. A link assembly as claimed in claim 5, wherein said adjustment means comprises a slot defined in said back support link apparatus for selectively adjusting the pivotal connection point of one of said first and second frame links.

8. A link assembly as claimed in claim 7, wherein said adjustment means comprises a plurality of spaced holes defined in said back support link apparatus for selectively adjusting the pivotable connection point of one of said third and fourth members.

9. A link assembly as claimed in claim 5, wherein said adjustment means comprises a slot defined in said back support link apparatus for selectively adjusting the pivotal connection point of one of said third and fourth members.

10. A link assembly as claimed in claim 1, wherein one of said links includes an arm for receiving a pushrod, said arm facilitating translation of said back frame movement to other elements of said chair.

11. A link assembly as claimed in claim 1, wherein said first and second members are connected to said back support link apparatus at spaced pivot points.

12. A chair comprising:

a base frame;

a seat frame connected to the base frame;

a back frame pivotably connected to the seat frame;

a displaceable back support carried by said back frame;

means disposed between said back frame support and said seat frame for moving said back frame relative to said seat frame, a link assembly connected to said back support and to said seat frame for displacing said back support relative to said back frame according to movement of said back frame relative to said seat frame;

said link assembly including a frame link apparatus having a first member and a second member, said members being connected at first and second pivot points respectively to the seat frame, and a back support link apparatus that is connected at a third pivot point to the displaceable back support;

said first member and said second member connecting at fourth and fifth pivot points to said back support link apparatus to facilitate said displacement of said back support according to said movement of said back frame; and adjustment means located on said link assembly for selectively adjusting the distance from one of said fourth or fifth pivot points to one of said first, second or third pivot points, said adjustment means facilitating adjustment of the extent of displacement of said back support relative to said movement of said back frame.

13. A chair as claimed in claim 12, wherein said adjustment means comprises a plurality of spaced holes defined in said back support link apparatus for selectively adjusting the pivotal connection point of one of said first and second members.

14. A chair as claimed in claim 12, wherein said adjustment means comprises a slot defined in said back support link apparatus for selectively adjusting the pivotal connection point of one of said first and second members.

15. A chair as claimed in claim 12, wherein said link assembly includes an arm for receiving a pushrod, said arm facilitating translation of said back frame movement to other elements of said chair.

16. A chair as claimed in claim 13, wherein said first and second members are connected to said back support link apparatus at spaced pivot points.

* * * * *